United States Patent [19]

Roig

[11] 4,094,540

[45] June 13, 1978

[54] CLOSURE DEVICE FOR LOCKING A MOVABLE ELEMENT WITH RESPECT TO ANOTHER ELEMENT

[75] Inventor: Joseph Antoine Roig, Yerres, France

[73] Assignee: Agence Nationale de Valorisation de la Recherche, Michelis, France

[21] Appl. No.: 571,322

[22] Filed: Apr. 24, 1975

[30] Foreign Application Priority Data

| | | |
|---|---|---|
| Apr. 24, 1974 | France | 74 14138 |
| Feb. 11, 1975 | France | 75 04195 |

[51] Int. Cl.[2] ..... E05C 3/10

[52] U.S. Cl. ..... 292/214; 292/306; 292/341.17

[58] Field of Search ..... 292/213–217, 292/221, 227, 275, 303, 304, 306, 341.15, DIG. 40, 341.17

[56] References Cited

U.S. PATENT DOCUMENTS

| | | | |
|---|---|---|---|
| 600,864 | 3/1898 | Glover | 292/306 |
| 1,399,105 | 12/1921 | Cozens | 292/306 |
| 1,593,227 | 7/1926 | Taylor | 292/DIG. 40 |
| 1,653,011 | 12/1927 | Jahn et al. | 292/306 |
| 1,944,450 | 1/1934 | Myers | 292/227 X |
| 2,464,178 | 3/1949 | Green et al. | 292/306 |
| 2,877,035 | 3/1959 | Claude-Mantle | 292/306 X |

FOREIGN PATENT DOCUMENTS

| | | | |
|---|---|---|---|
| 1,142,527 | 3/1960 | Germany. | |
| 268,271 | 10/1929 | Italy | 292/341.15 |
| 1,160 of | 1871 | United Kingdom | 292/221 |

*Primary Examiner*—Richard E. Moore
*Attorney, Agent, or Firm*—Alan H. Levine

[57] ABSTRACT

A closure device including a male member and female member, one mounted on a movable element and the other on another element. The male member includes a flat plate of substantially constant thickness, and the female member has a portion provided with an elongated cutout having a width slightly larger than the thickness of the flat plate. The cutout-bearing portion is pivotable in one direction upon introduction of the flat plate into the cutout, and pivots in the other direction to wedge the plate and prevent withdrawal thereof. Resilient means urge the cutout-bearing portion toward its wedging position, and handle means are provided for returning said portion to its unwedged position to permit withdrawal of the flat plate.

26 Claims, 16 Drawing Figures

CLOSURE DEVICE FOR LOCKING A MOVABLE ELEMENT WITH RESPECT TO ANOTHER ELEMENT

The present invention relates to a closure device intended to assure the immobilizing of a movable element with respect to another element, which comprises a male member and a female member each mounted on a respective element and capable of cooperating with each other by wedging action.

Such closure devices have already been proposed for automobile hoods in U.S. Pat. No. 2,789,848 and French Pat. No. 2,041,531. However, they do not permit a very easy introduction and removal of the male member, particularly when the latter must be of simple shape and not protrude excessively, as in the case of the doors of rooms or of pieces of furniture.

The object of the present invention is to overcome the above drawbacks and to provide a very simple closure device which is particularly suitable as a lock for the doors of dwellings, cars, trunks, cabinets, or the like. It permits the possible closing of such elements without impact or noise, by simply pushing the hinged portion, without it being necessary to act on the handle of a lock.

Furthermore, the invention makes it possible to provide an arrangement in which the removal of the male member from the female member can be effected both in the direction of relative displacement of the movable elements and in a direction perpendicular thereto.

The closure device in accordance with the invention which is intended to assure the immobilizing of a movable element with respect to another element comprises a male member and a female member each mounted on its respective element and capable of cooperating with each other by wedging action. The male member comprises a flat-plate portion of substantially constant thickness parallel to one direction of displacement of the elements with respect to each other and protruding in a given direction from a portion of the element on which said male member is fastened.

The female member, which is fastened to the other element, comprises a flat-piece portion provided with a cutout extending from one of its edges, which is elongated in the direction perpendicular to the direction of relative displacement of the movable elements and parallel to the plane of the plate portion of the male member in closed position, the width of said cutout being slightly greater than the thickness of the said plate portion of the male member. The flat part is floatingly mounted in a box so that it can pivot around an axis parallel to the direction of the elongated cutout between a non-wedging postion in which the flat-piece portion is substantially perpendicular to the said direction of displacement of the movable element with respect to the other element and a wedged position in which it is inclined with respect to the unwedged position, said plate being capable of engaging in the cutout of the part upon the bringing together of said elements and of being held therein by wedging. A spring is placed against the flat part in order to urge the latter towards its wedged position.

When a door, for instance, is closed, the cutout of the female member is engaged on the male member which is fastened to the door jamb. The pressure which is exerted upon pushing the door compresses the spring which is intended to maintain the female member in oblique position (with wedging), pushes the female member back until it is perpendicular with the male member and permits the sliding of the cutout over the male member until the door strikes against its jamb if the pushing is continued.

As soon as the movement is stopped, the female member which is acted on by the spring assumes a position which assures locking on the male member by wedging action; the opening can be effected by bringing the female member perpendicular to the latch by means of a manually controlled member such as a handle, knob, key, etc., or by withdrawing the male member by sliding in the direction of the cutout of the female member.

In a first variant of the invention, means are provided to permit the release of the plate, which means act in opposition to the means for the elastic return of the female member and which comprise at least one handle on the element which bears the female member, said handle being movable with respect to the case of the female member and being connected to a lever which transmits the movement of the handle to the flat part of the female member in order to push said part back, against its elastic return means, towards its unwedged position, thus unlocking the device. The transmission lever is itself provided with a return spring which urges it towards a closed position in which it does not push the flat part back towards its unwedged position.

This return spring of the lever preferably also acts on the handle in order to bring it back into a position which normally corresponds to closing.

Since the use of doors of ordinary rooms has for a long time made handles of the lever-handle type customary, which are actuated by rotation around an axis, the present invention contemplates the adaptation of such handles to the wedge closing device of the invention. The handle upon turning carries along with it on rotation the above mentioned lever which is provided with a guide yoke the arms of which are arranged on opposite sides of the flat part of the female member in such a way that the rotation of the handle results in a guiding of the flat part by the yoke, which guiding brings it into its unwedged position in opposition to its elastic return means. The lever is rigidly connected with the shaft of the handle and the return spring of the lever at the same time brings the handle back into closed position.

In accordance with one very advantageous feature of the invention, a functionally symmetrical arrangement of the closure device is contemplated in order to permit the mounting thereof on doors which open in a direct trigonometric direction or in an inverse trigonometric direction.

Such a reversible device will comprise as means for the elastic return of the female member a spring arranged between the case and the flat part with a position for receiving this spring on each side of the flat part. The construction itself of the assembly is preferably symmetrical with respect to a plane perpendicular to the direction of displacement of the movable elements, at least when the flat part is in its unwedged position, with the exception of the return spring of the latter which is arranged on one side or the other of the flat part.

In accordance with another aspect of the invention, the Applicant has found that the closure device in accordance with the invention lends itself very advantageously to a simpler and more logical manner of opening than the turning of a lever-handle closure.

As a matter of fact, contrary to the lever-handle closure which must be displaced transversely to the direction of relative displacement of the movable elements, the female member of the present device must be pushed back in this direction of relative displacement.

For this reason in accordance with the invention another variant embodiment of the opening control means is so arranged that if the door is to be opened by pulling towards the operator the unlocking of the female member also takes place by the pulling of a handle towards the operator. If on the other hand the opening is to be effected by pushing against the door, the opening control device will be arranged so that the unlocking takes place also by pushing on an unlocking handle.

Accordingly, the closure device in accordance with this variant of the invention is characterized by the fact that the aforementioned lever (for transmission of the movement of the handle) is an elongated plate which rests on one side against a stop provided on a portion of the handle penetrating into the case, that the said handle is capable of being actuated by pulling or pushing in the direction of relative displacement of the movable elements, that the action on the handle displaces the lever by means of the stop, and that the flat part of the female member rests against another portion of the elongated plate constituting the lever so that it can be brought by the lever back into its unwedged position by actuating the handle.

In practice the lever is arranged transverse to the direction of actuation of the handle so that actuation of the handle displaces the lever substantially parallel to itself. The return spring for the lever rests on the one side against the case of the female member and on the other side against the elongated plate of the lever so as to maintain the latter against the stop of the handle. If the opening is to be effected by pushing against the door, the lever is arranged between the housing and the return spring of the lever and the handle in order to maintain the handle in a pulled position, the opening being effected by pushing on the handle against the action of the return spring. If on the other hand, the opening is to be effected by pulling the door, the return spring of the lever is arranged between the handle and the lever in order to maintain the latter in a pushed position, the opening taking place by pulling on the handle.

Of course, except in the event that the closure device is attached to the door of a piece of furniture or a cupboard it is generally necessary to have two handles, one on each side of the door, the handles being connected together by a common support rod which passes through the case of the female member so that the first handle is driven in a pushed direction when the second is pulled, and vice versa, in order to permit opening of the door by a person located on either side thereof by acting on the corresponding handle in the direction of opening of the door.

It is not always desirable, however, in these doors that the two handles be strictly symmetrical. As a matter of fact in the case of bathrooms, bedrooms, etc. it is desirable to be able to lock from the inside in as simple a manner as possible and possibly close with a key from the outside (as in the case of hotel rooms).

For this purpose, the handle located within the room, which is normally actuated by pulling or pushing, is also in accordance with the invention capable of turning (for instance a half a revolution). Upon turning it carries along in rotation a blocking part fastened on the support rod of the handle. A stationary stop cooperates with the blocking part when the turning handle is in a first position in order to prevent transverse displacement by pulling or pushing of the handles, the rotating of the handle towards a second position acting to free the blocking piece from the fixed stop and permit the opening of the door by pulling or pushing a handle.

As a variant, the other handle is simply mounted for free rotation on the common support rod of the two handles and is provided with a key safety device which acts directly on the blocking part in order to turn it into the position in which it blocks transverse displacement of the two handles.

In accordance with another variant of the invention, the possibility is provided of freeing the male member from the cutout of the female member due to means for displacement of the male and female members with respect to each other substantially in the direction of the cutout of the female member, and due to an opening in the housing of the female member such that it permits the passage of the male member both in the direction of the cutout and in the direction of relative displacement of the movable elements to be locked.

In other words, contrary to the methods of opening of the previous variants which consist in bringing the flat part of the female member into its unwedged position, the male member is caused to slide in the cutout of the female member in the direction of said cutout and not in a direction perpendicular to the flat part. By direction of the cutout there is understood here the direction of its parallel edges which adjoin the edge of the flat part.

It is thus no longer necessary in accordance with the invention to provide means which penetrate into the case of the female member in order to bring said member back into a position perpendicular to the direction of displacement of the movable elements to be locked.

Two particularly interesting embodiments of this variant will be described.

In one a handle causes the male member to pivot in its own plane around an axis which is sufficiently far from the cutout for the end of the male member to slide substantially in the direction of the cutout. This is particularly interesting for the closing of sliding doors.

In the other, a handle acts on a cable or rod to displace the male member strictly in the direction of the cutout. This is particularly interesting in the case of windows of the type which is ordinarily closed by a casement bolt.

Other applications than doors and windows may of course be contemplated, the precise form of embodiment varying in accordance with these applications.

In particular it is possible to provide in accordance with the principle of the invention closure devices for safety belts in automobiles.

Other characteristics and advantages of the invention will become evident from the following detailed description given with reference to the accompanying drawings, in which:

FIG. 1*a* is a side view of the immobilizing device in accordance with the invention with its male part fastened to a door jamb and its female part on a door;

FIG. 1*b* is a face view of the door of FIG. 1*a*, showing the female part alone;

In all these figures the front case portions have been removed whenever this facilitates understanding.

Figure 1A:
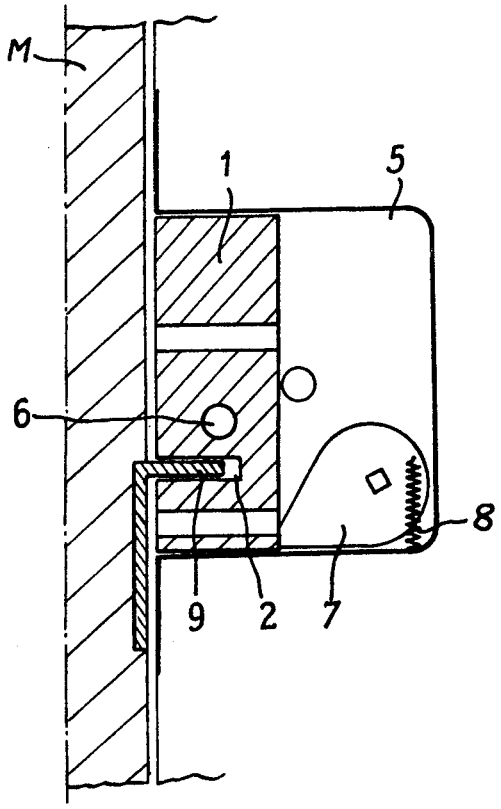
Figure 1B:
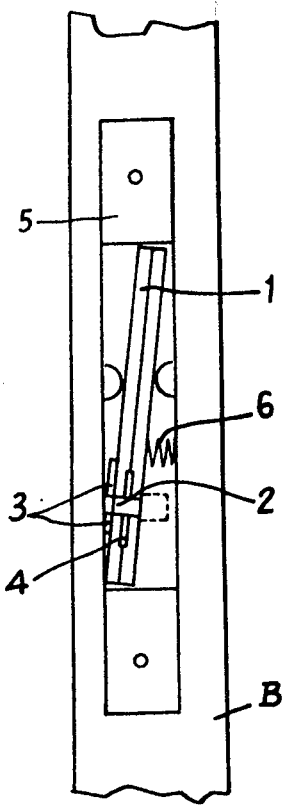
Figure 2:
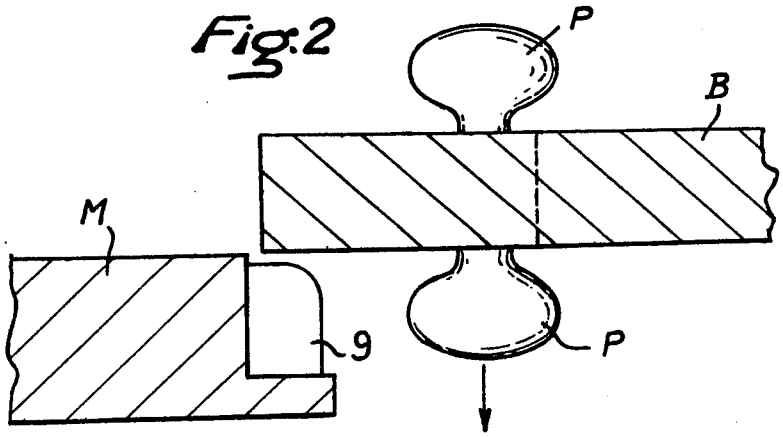
FIG. 2 is a top view of FIGS. 1*a* and 1*b*, showing the shape of the male member.

The closure device of the invention is shown in general in FIGS. 1*a*, 1*b* and 2 as used for the closing of a door B on a fixed jamb M. It comprises a male member fastened to the jamb M and a female member located in a case 5 fastened to the door B.

The female member is formed of a flat part 1 mounted in floating fashion in the case 5. This flat part is provided, extending from one of its edges, with a cutout 2 which comprises a riveted or glued portion of plastic material 3 and blades of heat-treated steel 4. The flat part is held freely in oblique position in the case 5 by means of a spring 6, and a control mechanism 7 (several variants of which will be described below) is positioned in the case of the lock with its return spring 8. Moreover, the male member 9 is a plate part fastened so as to protrude from the jamb 4 of the door or fixed portion. Upon pushing against the door leaf B by means of the handles P the cutout comes opposite the male member 9 and slides on it, compressing the spring 6 so as to permit the flat piece 1 to place itself perpendicular to the plate 9. As soon as the movement is stopped, the cut flat piece, under the action of the spring 6, assures the blocking, and the unblocking is effected by means of the operating mechanism 7 by actuating the handles P connected to said operating mechanism.

The female member may consist of two or more pieces of steel juxtaposed with the cutout, the first piece having plastic on its front face. Each piece being maintained by its own spring. The male member of flat steel may have notches provided at its lower part in order to increase the wedging action. It may be represented in order possibly to be adjusted in all directions. The support is screwed onto the door jamb M.

The male member 9 comprises a rounded portion to assist in penetration into the cutout of the female member. The case 5 of the latter is provided with a front opening and a side opening to permit the lateral passage of the male member into the cutout so that the plate portion 9 protrudes in a direction perpendicular to the direction of displacement of the door leaf, which is much more advantageous than in the arrangements of the prior art in which the male member was in the form of a hook shape with the danger of hooking.

Figure 3:
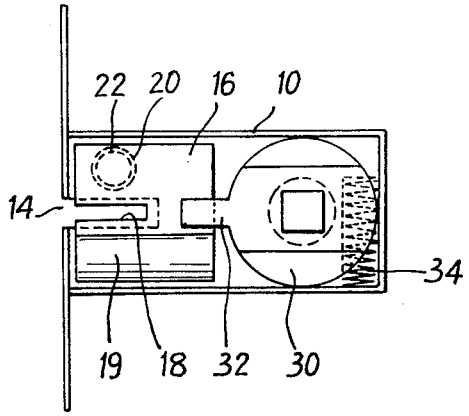
FIGS. 3 to 5 show a first embodiment of the opening device in accordance with the invention in the case of a handle intended to be actuated by rotation.
Figure 4:
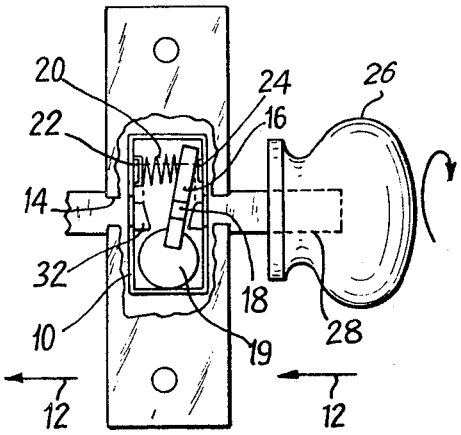
Figure 5:
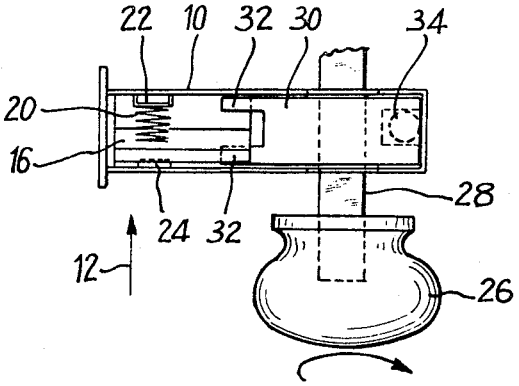

FIGS. 3, 4, and 5 show in lateral elevation, front view, and top view, respectively, the female portion of the closure device in accordance with the invention, with a first variant of the operating means for opening, actuated by pushing the flat piece of the female member in its case 10.

The case 10 is intended to be fastened on a door (not shown), the direction of opening of the door being indicated by the arrow 12, and it has a cutout 14 extending on one side parallel to this direction and on two sides perpendicular to this direction in order to permit the passage of a male member, such as that shown in FIG. 2, fastened on the stationary door jamb.

The female member comprises primarily a portion consisting of a flat part 16 provided with a cutout 18 positioned opposite the cutout of the case. It is pivotally mounted in said case by means of a cylindrical pivot 19 with which it is firmly connected. A spring 20 rests on one side against the case 10 and on the other side against the flat piece 16 to urge the latter towards an oblique position in which the wedging of a male member plate into the cutout 18 of the flat piece is assured.

In particular from FIGS. 4 and 5 it can be seen that two positions 22 and 24 are provided for the spring 20, one on each side of the flat piece 16, so that the female member of FIGS. 3 to 5 can be adapted to mounting on doors which open in the direct or opposite trigonometric direction, by simple positioning of the spring 20 on one side or the other of the flat piece.

In FIG. 5, only one opening handle 26 for the door has been shown (handle for unlocking the device). It is mounted on a support rod 28 whose square cross section penetrates freely into the case, the manual rotation of the handle resulting in rotation of the support rod and therefore the rotation of a lever which transmits the movement of the handle. This lever consists of a tumbler 30 which is capable of rotating within the case and a yoke 32. The tumbler 30 constitutes a pivot for the rotation of the handle and its support rod.

The yoke 32 is a guide yoke for the flat part; it has two symmetrical arms, located on opposite sides of the flat part 16. As the latter is normally urged into wedging (oblique) position by its spring 20, it is seen that the rotation of the yoke 32 has the effect of returning the flat part 16 perpendicular to the direction 12 of opening of the door and therefore of unlocking the wedge closure device.

The slightly beveled shape of the arms of the yoke improves the guiding of the flat part.

The symmetrical arrangement of the case, the tumbler and its guide yoke, and also of the flat part when it is in unwedged position (perpendicular to the arrow 12) permits attachment to a door which opens to the right or to the left by simply positioning the spring 20 either at its location 22 or at its location 24.

The guide yoke 32, the tumbler 30 and the handle 26 form an integral unit which is continuously urged by a spring 34 towards a position in which closing is possible automatically, that is to say the position shown in FIGS. 3 to 5 in which the guide yoke does not return the flat part towards its unwedged position but on the contrary leaves it free to move between the wedged (oblique) position and the unwedged position (perpendicular to the arrow 12) under the action of the penetration of the male member into the cutout.

Of course another handle, not shown, can be placed on the other side of the door, on the same square support rod 28.

Figure 8:
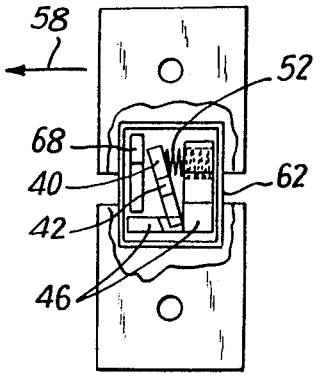
FIGS. 6 to 8 show a second embodiment of the opening device in accordance with the invention for a handle intended to be actuated by pulling or pushing in the direction of the opening of the door.
Figure 6:
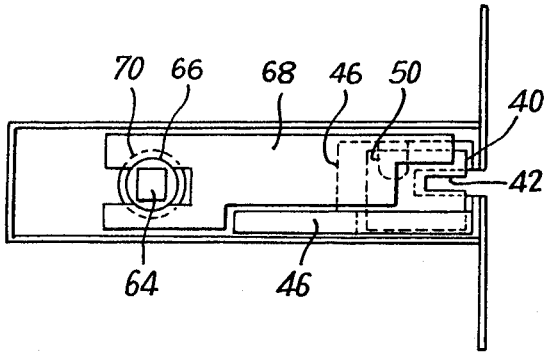
Figure 7:
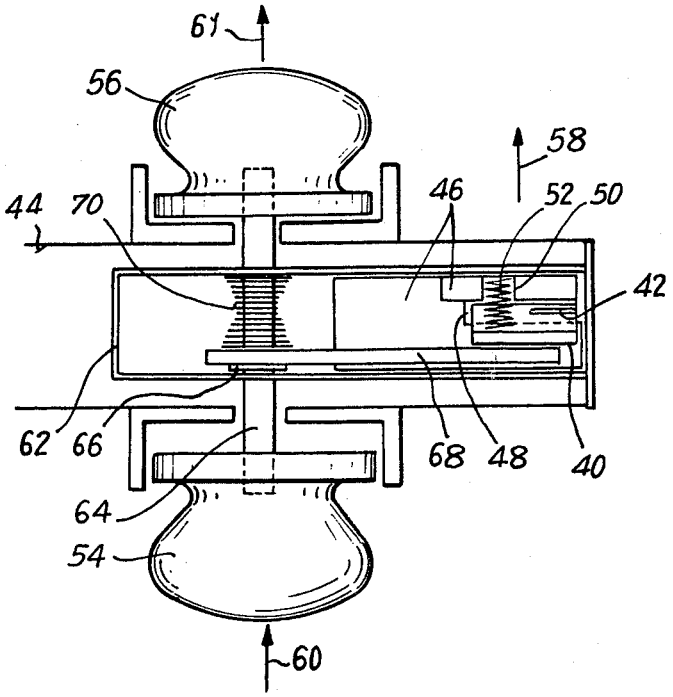

FIGS. 6 to 8 show an embodiment which differs from that of FIGS. 3 to 5 in that it corresponds to operation by pushing or pulling of a handle 40 and not by rotation thereof.

The closure device proper again comprises a flat part 40 provided with a cutout 42 to act as a female member mounted on the door 44, the male member, fastened on the stationary jamb of the door not being shown.

The flat piece 40 is housed in floating fashion in a block 46 comprising an elongated recess 48 of groove shape in order to receive the edge of the flat part and another recess 50 to receive a spring 52 for returning the flat part towards a (oblique) position in which it can retain, by wedging action, a male member which has penetrated into its cutout 42.

A handle 54 is provided on one side of the door 44 and a handle 56 on the other side. They are adapted to be operated by pushing or pulling when the door is to be opened (closing being automatic since the flat part is normally urged into its wedged position when the handle is not acted upon).

The direction of opening of the door is indicated by the arrow 58. In order to be logical it is therefore necessary for the unlocking of the female member to take place also by pushing the handle 54 in the same direction (arrow 60) or by pulling the handle 56 in the same direction (arrow 61).

The handles are connected together in their transverse movement by being fastened on a common support rod 64 which freely passes through the case 62 of the female member.

On this support rod 64 there is provided a stop 66 which cooperates with a bar 68 which transmits the movement of the handles to the flat piece 40 of the female member. The bar 68 is an elongated plate mounted at one of its ends on the support rod 64 against the stop 66, transverse to the rod 64, in such a manner that a movement of one of the handles in order to open the door pushes the bar 68 via the stop 66. The bar 68 then moves transversely in the case 62, as a whole parallel to itself, against a return spring 70 of said lever, which spring is mounted on the support rod 64 of the handles between the case and the lever (the lever itself being placed between said spring 70 and the stop 66). The stop may be merely a spacer tube placed over the support rod 64 between the lever and the handle 54 instead of the simple collar shown in FIGS. 6 and 7.

Upon moving transversely, under the action of a handle, the bar 68 at one of its ends pushes against the flat piece which normally rests against said end under the effect of its own return spring 52. The flat piece 40 is thus brought back into its vertical (unwedged) position in which it frees the male member which is engaged in the cutout 42 when the door is closed.

When the handle 54 or 56, which has been pulled (handle 56) or pushed (handle 54) to open the door, is released, the return spring 70 of the bar 68 returns the latter as well as the two handles into a closed position (normal position) in which the lever does not push the flat piece back into its unwedged position.

If the direction of opening of the door 44 is not the one indicated by the arrow 58 but rather the opposite direction, it will be seen that it is necessary to reverse the closing device, for instance by replacing the block 46 by a similar block which however is symmetrical to that of FIG. 2 so as to incline the flat piece 42 on the other side. It is then also of course necessary to reverse the positions of the bar 68, of the stop 66, and of the spring 70 with respect to a median plane perpendicular to the direction 58. For this reason it is advantageous to use as stop 66 a spacer tube which can easily be removed and can be placed on one side or the other over the support rod, the spring 70 being possibly also placed thereover but from the opposite side of the lever so as to maintain the lever applied against the stop.

It is of course possible to provide a block 46 of symmetrical construction, for instance with two parallel grooves to house the flat piece and two recesses for the return spring of the flat piece, so as thus to make possible the attachment of the same lock to doors which open either to the right or to the left. More simply yet, with the device shown in FIGS. 6 to 8, a total rotation of 180° of the entire closure device around an axis parallel to the direction of the cutout permits the positioning of the lock for opening either to the right or to the left, the block 46 being then either at the top or at the bottom of the case (in the case of a vertical door).

Figure 9:
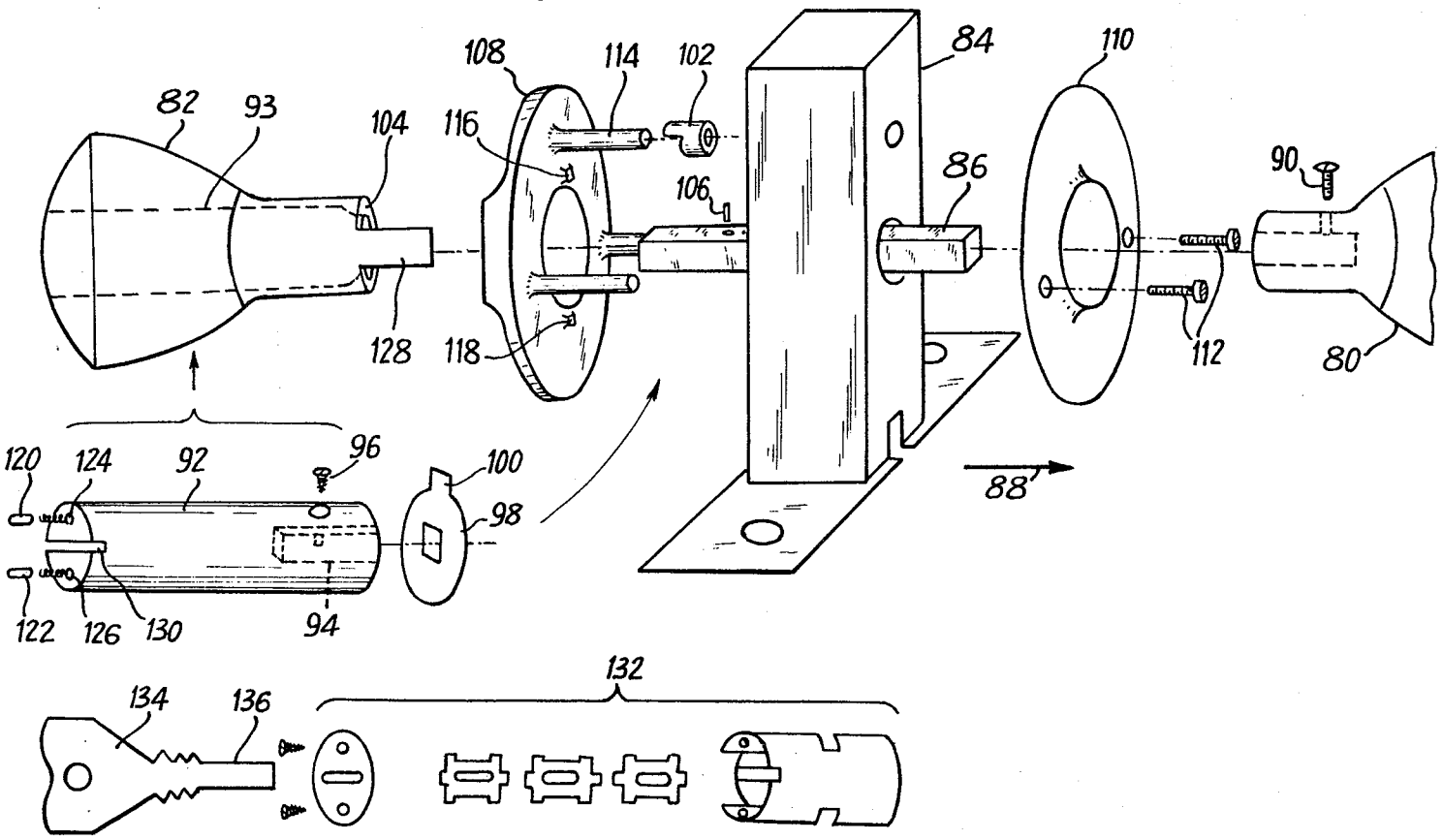
FIG. 9 shows a locking device adapted to the embodiment of FIGS. 6 to 8.

FIG. 9 shows a closure device with handles which can be operated by pushing and pulling, equivalent to the one shown in FIGS. 6 to 8 but provided furthermore with a locking device, for instance for use on a bathroom door.

For such a use it is advisable to be able from the inside of the room to prevent entrance by persons who are on the outside of the room. This is obtained in very simple manner, namely, by rotation of a fraction of a revolution of the inner handle which will have at least two positions, one in which the two handles can be freely pulled or pushed in order to open the door and the other (handle turned half a revolution with respect to the first position) in which the pulling and the pushing of the handles is prevented.

The wedge closure device proper is enclosed in a case 84 and is identical to that of FIGS. 6 to 8, opening being effected by displacement of the support rod 86 of the inner handle 80 and the outer handle 82 in the direction indicated by the arrow 88 (in the present case in which it is assumed for instance that the door opens towards the inside of the room). The handle 80 is made completely integral with the rod 86 by means of a locking screw 90 so that it can carry the said support rod 86 along with it in rotation, a circular cut being provided on said rod within the case at the place of the bar 68 so that such rotation is possible.

On the other hand, the handle 82 on the outside of the room is mounted for free rotation with respect to the rod 86 so that on the one hand it cannot turn the rod 86 while on the other hand the turning of the inner handle 80 has no direct effect on the handle 82.

This freely turnable mounting is obtained via a cylindrical barrel 92 inserted in a corresponding bore hole 93 in the handle, this barrel being made integral, by means of a blocking screw (or pin, etc.) 96, with the support rod 86 which penetrates into a square hole 94 in the barrel.

A blocking bolt 98, formed of a disk provided with a spur 100 at its periphery, is placed over the rod 86 so as to be driven in rotation by the turning of said rod 86. The spur 100 may, for a given turned position of the handle 80, assume a blocking position in which it cooperates with a bolt stop 102 which prevents any transverse movement of the blocking bolt 98.

As the blocking bolt is wedged between, on the one hand, the end 104 of the handle 82 and, on the other hand, a pin 106 (on the rod 86) which prevents it from moving on said rod, any transverse movement of the rod 86 is prevented when the bolt 98 is in its blocking position with respect to the bolt stop 102.

Two rosettes 108 and 110 are provided on each side of the door to hold the case 84 in the door and to permit the passage and the transverse movement of the handles 80 and 82. The rosette 108 has three studs, two of which pass through the case 84 up to the other rosette which is fastened on these two studs by screws 112. The third stud 114 passes through the case 84 and wedges the bolt stop 102 (placed over the stud 114) between the rosette 108 and one face of the case 84.

If the spur 100 of the blocking bolt is facing the bolt lock 102 any transverse movement if the handles is prevented. This position corresponds to a locking position of the handle 80. Any other position would be an unlocking position but in practice there will be established as the unlocking position of the handle 80 a position which is one half a turn away from the locking position. This is obtained first of all by means of two stops 116 and 118 provided on the rosette 108 in the circular path of the spur 100, the locking position corresponding to the arrival of the spur 100 against the stop 116 and the unlocking position corresponding to the arrival of the spur 100 against the stop 118. Of course any other means for defining a locking and an unlocking position can be used in place of the stops 116 and 118, for instance, a circular groove over a fraction of a revolution to constitute a recess for the spur 100 over a certain distance, the spur being stopped at each end of said groove.

Another means for assisting in defining a single locking position and a single unlocking position is indicated by way of example (which can be used in addition to the stops 116 and 118). This means is formed of diametrically opposite pins 120 and 122 mounted in recesses 124 and 126 provided on an end face of the barrel 92. These pins protrude slightly due to springs provided in these recesses. Diametrically opposite indentations are provided on the front face of the handle to correspond to the position of the pins 120 and 122 of the barrel so thatwhen the handle 80 is in its locked or unlocked position engagement of the pins in the indentations 120 and 122 takes place, holding the handle 80, the rod 86, and the barrel 92 in a well-defined stable locked or unlocked position. The intentional turning of the handle 80 to effect the locking and unlocking causes the pins 120 and 122 to retract, causing them to enter completely into their recess so as to permit the barrel to make a half-turn, at the end of which the pins are again engaged in the indentations.

The handle 82 on the outside of the room need not turn with respect to the case 84 and for this reason an extension 128 of the tube is provided containing the barrel 92, which extension comes to rest against a face of the case parallel to the arrow 88 to permit the transverse movement of the handle 82 and prevent its rotation.

As it is desirable in case of emergency to be able to open the door from the outside when it has been closed from the inside by the handle 80, a screwdriver slot 130 is provided on one face of the barrel with an indentation, not shown, on the outer face of the handle 82 to permit the passage of a screwdriver and directly act on the barrel and the support rod 86 with said screwdriver, so as to effect the unlocking by turning the blocking bolt 98.

Other means can of course be provided to unlock from the outside in case of emergency, for instance an identation on the side of the handle 82, the barrel being grooved. The insertion of a nail into the indentation makes it possible to turn the barrel gradually unitl the blocking bolt 98 has been sufficiently displaced.

Such a lock can also be provided with the possibility of closing by a key from the outside, prevention from entrance being still possible from the inside by rotation of the handle 80. In this case the assembly of a brahma lock 132 is housed with the barrel 92 in the bore 93 of the outer handle 82 and in this case it is necessary of course to provide a barrel 92 which is shorter (about twice as short) as the one shown in FIG. 9. It is also necessary that the key 134 which permits unlocking the brahma lock 132 (or any other key safety device) be longer than an ordinary key and terminate in a blade 136 having the shape of a small screwdriver which can pass through the brahma device and penetrate into the screwdriver slot 130 on the barrel 92.

Thus the key 134 penetrating into the brahma device unlocks it so as to permit its rotation as well as the roation of the barrel 92 which is driven along the blade 136 of the key so that the door can be locked or unlocked by the key 134 as well as by the interior handle 80. Of course, in this case the indentations which were provided on the front face of the handle 82 to receive the end of the pins 120 and 122 are also provided on the brahma device 132 in order to fulfill the same role.

Other extensions of the opening device in accordance with this invention can also be imagined by the man skilled in the art without thereby going beyond the scope of the invention as defined by the accompanying claims.

In particular it is possible to add to the handle push or pull opening device of FIGS. 6 to 8 an additional closure device with a dead bolt housed in a case within the case 84 and movable transversely in said case 84 upon the transverse movement of the handles, the closing of the dead bolt being possible when the handles are in normal closing position. The dead bolt then comes, when closed, to rest either in a keeper provided for this purpose on the casing of the door or simply behind the flat plate of the male member fastened to said casing in order to prevent any removal of the door since the bolt comes to rest against the fixed male member.

Figure 10:
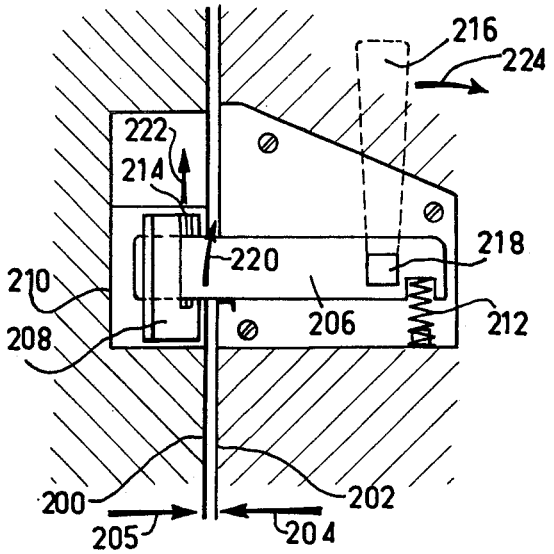
FIG. 10 shows a third embodiment of the invention in which the displacement means of the male member comprise a pivoted handle.

FIG. 10 shows the two movable elements of a sliding door. The direction of relative displacement of the movable elements with respect to each other is indicated by the arrows 204 and 205 which correspond to the closing of the door. The wedge closing device of this door comprises a male member 206 mounted on the element 202 and a female member 208 floatingly mounted in a case 210 which is itself fastened to the other element 200. The elastic return means for the female member 208 and the other parts contained in the case 210 are not shown; for the detail of these parts reference will be had to the other embodiments already described.

The closing of the sliding door is effected by simply pushing the elements 200 and 202 towards each other (in the direction indicated by the arrows 204 and 205), the male member being in the position shown in FIG. 10 and therefore protruding out of the movable element 202 in the direction of relative displacement of the movable elements. The male member is furthermore returned to this position of rest by a return spring 212. In this position the closing is automatic, the male member being capable of pentrating freely into the cutout 214 of the female member and not being able to emerge in the opposite direction due to the wedging effected by the obliqueness of the female member 208.

In order to open the sliding door a handle 216 is provided mounted on a square rod 218 transverse to the plane of the sliding door. The male member has a square hole through which the rod 218 passes so that the rotation of the handle 216 drives the rod 218 and therefore causes the male member 206 to pivot in its own plane. this pivoting has the result that the end of the male member 206, inserted in the cutout, can slide in a direction indicated by the arrow 220, which is substantially the direction of the cutout 214 (arrow 222). The sliding in this direction is easy and frees the male member. As the operator moves the handle 216 in the direction indicated by the arrow 224, that is to say substantially in a direction opposite that of the arrow 204, the movable elements 200 and 202, which are unlocked, move to open the door.

Therefore, and this is a very important aspect of the invention, actuation of the handle in a single direction (arrow 224) effects the unlocking by lateral release of the male member and the displacement of the movable member 202.

In order to close the sliding door, the handle 216 is pushed in the direction opposite the arrow 224; the handle is limited in its movement by a stop which acts either directly on the handle or on the male member and which prevents its displacement beyond its normal return position in which the closing is automatic (position shown).

Figure 15:
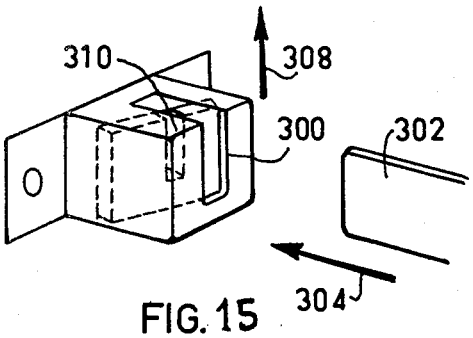
FIG. 15 is a perspective view of the case of the female member of the closure device in accordance with the invention.

The case 210 of the female member has an opening which extends both over its upper portion to permit the release of the male member and over its front portion to permit the penetration of the male member upon the closing (this opening 300 being clearly visible in FIG. 15.

Figure 11:
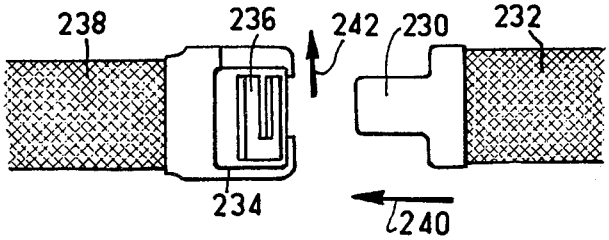
FIG. 11 shows a safety belt in accordance with the invention in which the penetration upon closing is longitudinal (in the direction of the belt) and opening is effected by simple transverse displacement of the two elements of the belt.
Figure 12:
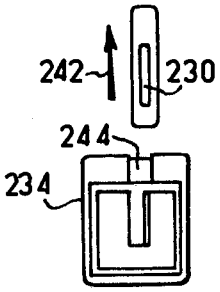
FIG. 12 is a front view of the female portion of the belt.

In FIGS. 11 and 12 there is shown a safety belt for passengers of an automobile in which the two elements of the belt to be connected form the means for the relative displacement of the male member and the female member in the direction of the cutout in the female member. This belt bears a closure device in accordance with the invention with the male member 230 on the belt element 232 and the case 234 of the female member 236 on the other belt element 238.

The automatic locking of the belt is effected by displacement of the male member towards the female member in the direction indicated by the arrow 240 and the wedging which follows therefrom withstands any pull in the direction opposite the arrow 240. In order to unlock the belt, the user merely displaces the male member in the direction of the opening of the cutout of the female member (arrow 242). Only a slight friction opposes the withdrawal of the male member and the unlocking is therefore very easy.

A slot 244 (FIG. 12) is provided in the case 234 to permit the emergence of the male member from the upper portion of the case and its introduction through the front portion (see FIG. 15, slot 300). The device is therefore very simple to use since the belt is clapsed by bringing the belt elements together in the direction indicated by the arrow 240 and is opened by moving away in the direction 242. This obviously presupposes that the tensile forces exerted on the belt are longitudional (direction opposite the arrow 240) and in this case it is this longitudinal direction which will be called the direction of relative displacement of the belt elements; the device must withstand opening forces in this direction.

Figure 13:
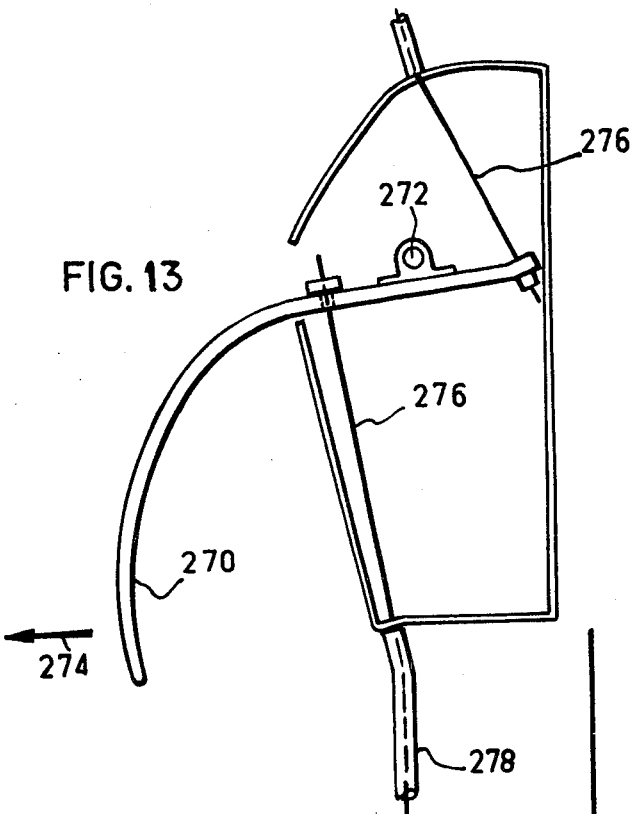
FIG. 13 is a side view of an embodiment of the closure device for use with a window, with associated unlocking means.

FIG. 13 shows the closure device in accordance with the invention mounted on a conventional casement window with its associated opening means. It is known that ordinarily a casement window is opened by turning a handle which longitudinally pulls a vertical rod which penetrates into an opening in the floor or the ceiling. The closing is also effected in this way. However, it is advantageous for the closing to take place without action on the handle and this is achieved in accordance with the present invention by providing an opening in the case of the female member (fastened for instance to the ground) in order to assure the penetration of a male member in the direction of closing of the window, the closing taking place automatically by wedging, and also to permit the withdrawal of the male member in the direction towards the cutout of the female member; furthermore means for the displacement of the male member in this direction are provided.

In FIG. 13 a window sash 250 is capable of moving in the direction indicated by the arrow 252 to assure the closing of the window against a stationary part 254 on the ground (and possibly also on the ceiling, the part on the ground alone being shown, and the other being symmetrical). In this embodiment the case 256 of the female member 258 is fastened to the ground. It has a front opening 260 which can be noted in FIG. 14 and an upper opening 262. The male member 264 is borne by the window sash; its plane is parallel to the direction 252 and it can penetrate in this direction into the case of the female member and remain held therein by wedge action.

Figure 14:
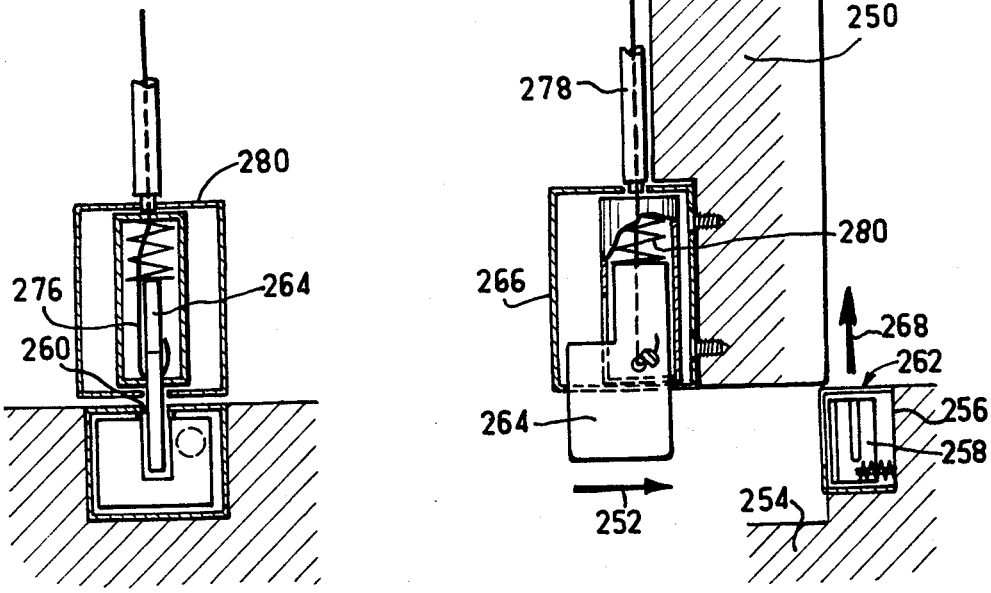
FIG. 14 is a front view of a portion of FIG. 13.

The male member in general protrudes downwardly and when it penetrates into the female member this is done by its edge. The male member is itself contained in a case 266 into which it can retract, in the direction indicated by the arrow 268 which is the direction of the cutout of the female member, under the action of the control means, one example of which is shown in FIGS. 13 and 14.

These means for the displacement of the male member comprise a handle 270 which pivots around a shaft 272. The action on the handle for opening the window is effected by pulling in the direction indicated by the arrow 274 which is furthermore advantageously in the direction of displacement of the entire window (direction of displacement of the sash of sashes to be locked relative to the part fastened to the ground or the ceiling).

Pulling the handle 270 results in a pulling on cables 276 contained in a rigid sheath 278 which has the effect of pulling upward (in the direction indicated by the arrow 268) the male member which is attached to said cable, against the action of a return spring 280 which urges the male member downward into a protruding position. The cable itself serves as a stop to prevent the male member from descending beyond a certain position. A rigid tube 282 contained in the case of the male member and containing the male member and the spring 280 assures the guiding of the male member and spring.

Of course, the means for the displacement of the male member have been given merely by way of example; this means can consist of a turning handle instead of a handle which is adapted to be pulled; it may also consist of means with a rigid rod instead of cables sliding in a sheath, the rod being firmly connected to the male member. The important thing is that the closure device is, in the embodiments of FIGS. 10 to 15, provided with an opening in the case of the female member to permit the passage of the male member in two different directions, i.e., the direction of normal displacement of the movable elements to be closed and the direction towards the cutout of the female member, and that means for displacement of the male member in the direction of the cutout when the elements are closed are provided.

FIG. 15 better illustrates the presence of this opening 300 both at the front (for the passage of the male member 302 in the direction 304 of displacement of the moving elements) and on top (for the emergence of the male member in the direction 308 of the cutout 310 of the female member).

The means for displacement of the male member are not shown in FIG. 15; they vary depending on the application contemplated, of which nonlimitative examples have been given in the above description.

It should be noted that, particularly in the case of windows, trunks, tail doors, or hoods of vehicles it may be advisable to provide an opening which is more or less pronounced, with wedging in any intermediate position.

For this purpose it will be sufficient for the male member to be sufficiently long and for the case of the female member to be able to receive said male member (for instance by providing a rear opening on the case or a case which is sufficiently deep behind the female member.

For unlocking it may then be advisable to displace the female member in the direction towards the cutout (rather than the male member as has been done in the arrangements described with reference to FIGS. 10 and 13). The important thing obviously is the relative direction of displacement of the male member and the female member, which is furthermore perfectly illustrated by the safety belt of FIGS. 11 and 12.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A closure comprising:

(a) two elements relatively movable toward and away from each other, and means for separably locking said elements together, said locking means comprising:

(b) a male member in the form of a flat plate mounted on and protruding from one of said elements, the plane containing said plate being in the direction of relative movement between said elements, (c) a casing carried by the other of said elements, said casing having an opening through which said plate can move freely into and out of said casing when the two elements are brought together and separated, said opening extending continuously along two adjacent sides of said casing, (d) a female member within said casing, said female member being a flat plate movable about an axis perpendicular to the direction of relative movement between said elements between a position substantially perpendicular to the direction of relative movement between the elements and a position oblique to that direction, said plate having an elongated slot perpendicular to the direction of relative movement between said elements, said slot being aligned with said casing opening and slightly wider than the thickness of said male member plate, and said slot extending to one edge of said plate, and (e) resilient means urging said female member plate toward its oblique position, said male member plate moving said female member plate toward its perpendicular position against the force of said resilient means when said elements are moved together to insert said male member plate through said casing opening and said slot in said female member plate, said male member plate becoming wedged within said slot upon attempted separation of said elements.

2. Closure according to claim 1 including means for moving said female member plate toward its perpendicular position when said elements are together so as to permit removal of said male member plate from said slot and separation of said elements.

3. Closure according to claim 1 including means for displacing the male and female members with respect to each other substantially in the direction of the elongated slot in said female member plate.

4. Closure according to claim 1, characterized by the fact that it is provided with means for increasing the frictional engagement between the female member and the male member.

5. Closure according to claim 4, characterized by the fact that the means for increasing the wedging consist of notches provided on the said flat plate of the male member.

6. Closure according to claim 1, characterized by the fact that the means for permitting the removal of the plate of the male member from the cutout of the female member comprise a handle on the element which bears the female member, said handle being movable with respect to the case of the female member and being connected to a bar for transmitting the movement of the handle to the flat piece of the female member, by the fact that the bar is adapted to push the latter back into its unwedged position against the elastic return means of the flat piece, and by the fact that the bar is provided with a return spring of its own to urge it towards a position where it does not push the flat piece back towards its unwedged position.

7. Closure according to claim 6, characterized by the fact that the return spring of the bar itself also acts on the handle to bring the latter back into a normal position corresponding to the joined condition of said elements.

8. Closure according to claim 6, characterized by the fact that the handle is a turnable handle which carries along the said bar with it in rotation, and by the fact that the bar is provided with a guide yoke the arms of which are arranged on opposite sides of the flat plate of the female member so that the action of rotation of the handle results in a guiding of said flat plate by the yoke, returning it into its unwedged position against the action of the resilient means.

9. Closure according to claim 8 characterized by the fact that the resilient means of the flat plate consist of a spring arranged between the case of the female member and the flat plate, and that a first receiving position for said spring is provided on one side of the flat plate and a second position on the opposide side of the flat plate.

10. Closure according to claim 9, characterized by the fact that the entire female member is essentially symmetrical with respect to a plane perpendicular to the direction of displacement of the movable elements when the flat plate is in its unwedged position, with the exception of the spring for the latter which is arranged either on one side or the other of the flat plate depending upon the desired direction of displacement of the movable elements upon closing.

11. Closure according to claim 6, characterizedby the fact that the said bar is an elongated plate resting on one side against a portion of the handle penetrating into the case, that the said handle is capable of being actuated by push or pull in the direction of relative displacement of the moving elements, that the action on the handle displaces the bar, and that the flat piece of the female member rests against another portion of the bar so that it can be returned by the bar into its unwedged position by actuation of the handle.

12. Closure according to claim 11, characterized by the fact that the bar is arranged transversely to the direction of actuation of the handle so that actuation of the handle displaces the bar substantially parallel to itself.

13. Closure according to claim 12, characterized by the fact that the return spring of the bar rests on the one side on the case of the female member and on the other side on the bar to maintain the latter against a stop which is provided on a portion of the handle within the case in order to transmit the movement of the handle to the lever.

14. Closure according to claim 13, characterized by the fact that the bar is disposed between the stop of the handle and the return spring of the bar in order to urge the handle towards a pulled position, the opening taking place by pushing on the handle against the action of the return spring.

15. Closure according the claim 13, characterized by the fact that the return spring of the bar is disposed between the handle and the bar in order to maintain the latter in a pushed position, the opening being effected by pulling the handle.

16. Closure according to claim 11, adapted to be mounted on a room door, characterized by the fact that it comprises a second handle mounted on a common support rod with the first, each handle being located on its respective side of the door, the first handle being carried along into a pushed position when the second handle is pulled and vice versa, in order to permit opening by a person located on either side of the door by actuating the corresponding handle in the direction of opening of the door.

17. Closure according to claim 16, characterized by the fact that it comprises a blocking piece fastened on the common support rod of the two handles, that at least one handle is adapted to turn while carrying the blocking piece in rotation with it, that a stationary stop is provided which cooperates with the blocking piece when the turning handle is in a first position in order to prevent transverse displacement by pull or push of the handles, the turning of the handle towards a second position acting to free the blocking piece from the fixed stop and permit the opening of the door by pulling or pushing a handle.

18. Closure according to claim 17, characterized by the fact that the other handle is mounted for free rotation onthe common support rod of the handles and that it is provided with a key safety device acting on the blocking piece to lock the transverse displacement of the two handles.

19. Closure according to claim 3, characterized by the fact that the means for displacing the male and female members with respect to each other comprise a handle which acts on the male member and is adapted to pivot it in its own plane around an axis which is spaced from the cutout.

20. Closure according to claim 19, characterized by the fact that the handle is a pivoted handle that the male member is rigidly connected with the handle and mounted around the same axis as the handle, and that a return spring is provided which acts to bring the male member and the handle back into a closed position.

21. Closure according to claim 3, characterized by the fact that the means for displacing the male and female members with respect to each other in the direction of the cutout comprise a rod or a cable connected to the male member and adapted to slide in a direction which is the direction of the elongated cutout when the movable elements are in closed position, and opening control members adapted to cause the rod or the cable to slide and thus drive the male member out of the cutout.

22. Closure according to claim 21, characterized by the fact that a spring is provided for returning the male member towards a position in which it can introduce itself into the cutout of the female member by simple pushing of the movable members in their direction of relative displacement.

23. Device according to claim 21, characterized by the fact that a handle is provided which can be actuated by push or pull in order to act on the rod or cable, the direction of action on the handle being substantially the same as the direction of displacement of the movable elements.

24. Closure according to claim 3 for the interlocking of two elements of a safety belt, characterized by the fact that the means for the relative displacement of the male and female member in the direction of the cutout consists of the two belt elements themselves.

25. Closure according to claim 3, characterized by the fact that the case of the female member is provided with a rear opening to permit the passage of the male member from one side to the other, the male member being capable of penetrating to a greater or lesser depth into the case and of being held therein by wedging in any intermediate position of penetration.

26. Closure according to claim 3, characterized by the fact that the case of the female member is sufficiently deep in the direction of penetration of the male member and the male member is sufficiently long to permit a penetration of greater or lesser depth and the holding by wedge action of the male member in any intermediate position of penetration.

* * * * *